United States Patent [19]

Bergstrom et al.

[11] 4,185,454

[45] Jan. 29, 1980

[54] LINK STUD INSERTER

[75] Inventors: Rolf Bergström; Stig Svensson, both of Ramnäs, Sweden

[73] Assignee: Bulten-Kanthal AB, Hallstahammar, Sweden

[21] Appl. No.: 914,819

[22] Filed: Jun. 12, 1978

[30] Foreign Application Priority Data

Jun. 17, 1977 [SE] Sweden ..... 7707079

[51] Int. Cl.[2] ..... B21L 11/14

[52] U.S. Cl. ..... 59/1; 59/16; 59/34

[58] Field of Search ..... 59/1, 7, 8, 31, 34, 59/35, 16; 219/51, 52

[56] References Cited

U.S. PATENT DOCUMENTS

| | | | |
|---|---|---|---|
| 1,510,197 | 9/1924 | Ryan | 219/51 |
| 2,763,768 | 9/1956 | Coffey | 219/51 |
| 3,977,180 | 8/1976 | Booth | 59/31 |

*Primary Examiner*—Francis S. Husar
*Assistant Examiner*—Gene P. Crosby
*Attorney, Agent, or Firm*—Pollock, Vande Sande & Priddy

[57] ABSTRACT

A device for inserting a link stud into a chain link to permit subsequent fastening of the link stud in the chain link in the region of the stud and/or by welding same. According to the invention, a pivotably mounted arm is arranged in operative connection to a stud fastening station, the arm carrying at its free end an operable holding means for holding said link stud and being pivotable back and forth between a collecting position adjacent a link stud feeding device and a delivery position adjacent the stud fastening station, and the holding means is resiliently mounted at the free end of the arm so as to enable guiding of the holding means into a well-defined position relative to a chain link situated in the stud fastening station.

14 Claims, 3 Drawing Figures

1
2
3
4
5
6
7
8
9
10
11
12
13
14
15
16
17
18
19
20
21
22
23
24
25
26a
26b
28a
28b
29
P1
P2
P3

LINK STUD INSERTER

BACKGROUND OF THE INVENTION

Particularly heavy chains, such as anchor chains, are often provided with a special support or stud in each of their substantially oval links, this stud being fastened by pressing or welding the opposite ends thereof to the inside of the long sides of the link.

The invention relates to a device for inserting such a link stud into a chain link, in particular during the manufacture of the chain in an automatic chain production plant, wherein the link stud is fastened by compressing each chain link in the region of the stud and/or by welding.

Normally, a strong hydraulic press device having two press heads is used, the heads being moved towards each other, forcing the long sides of the chain link towards each other so that a link stud inserted therebetween is permanently fastened due to the plastic deformation of the chain link.

However, the insertion of the stud into the chain link, which is typically the previously produced link of a chain end hanging down during the production process, requires great accuracy and involves difficulties, especially when automatically operating devices are used.

SUMMARY OF THE INVENTION

According to the invention, it has in fact been possible to eliminate these difficulties by means of a device characterized in that a pivotably mounted arm is arranged in operative connection to a stud fastening station (in which the link stud is fastened by compressing the link and/or by welding), said arm carrying at its free end operable holding means for holding the link stud and being adapted to be pivoted back and forth between a collecting position adjacent a link stud feeding device and a delivery position adjacent said stud fastening station, and that said holding means is resiliently mounted at the free end of said arm so as to enable guiding of said holding means into a well-defined position relative to a chain link situated in said stud fastening station.

Suitable further features appear from the following detailed description of a preferred embodiment of the device according to the invention, reference being made to the accompanying drawings.

DESCRIPTION OF AN EXEMPLARY EMBODIMENT

Figure 1:
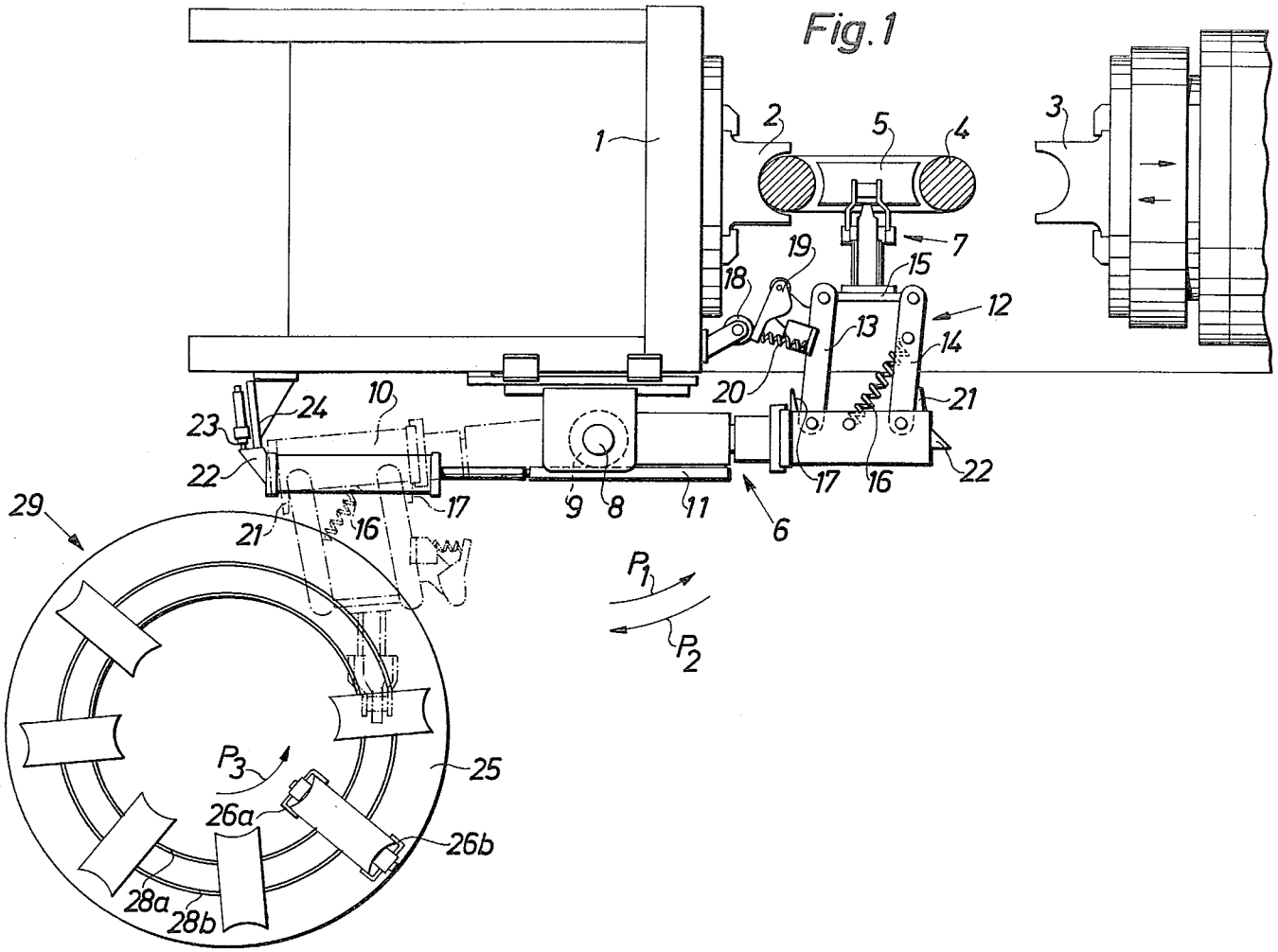
FIG. 1 is a plan view of the device according to the invention.

At the top of FIG. 1, a hydraulic press device is shown having a stationary press head 2 secured to a machine frame 1 and an opposing press head 3, which is movable back and forth by hydraulic actuation, a chain link 4, which is to be provided with a transverse stud 5, being placed between the two press heads 2,3.

The chain links 4 may constitute the last produced link of a chain under manufacture and hanging vertically in a chain end suspended from a traversing device or the like (not shown), said chain end being advanced along a linear production line including various operative stations. In this case, the production line is assumed to extend through the space between the press heads 2, 3 at right angles to the direction of movement of the latter relative to each other. Furthermore, it is assumed that the chain link 4, prior to the insertion of the stud 5 and compression by means of the press heads 2, 3, is kept in a well-defined position (the shown position) by suitable means (not shown).

Figure 3:
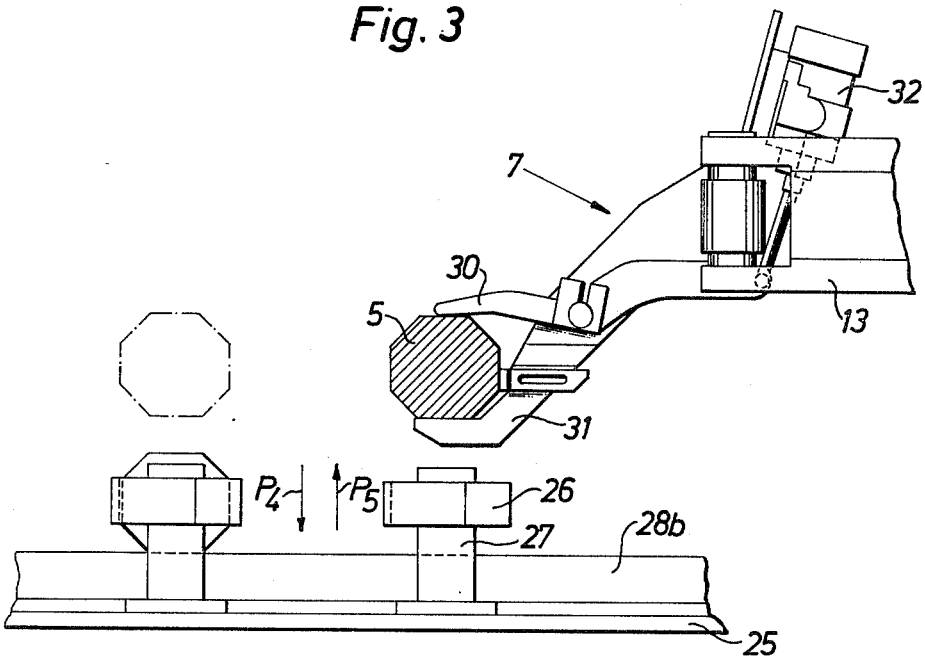
FIG. 3 is a side view of a pair of tongs in collecting position at the stud feeding table.

For the insertion of the stud 5 into the chain link 4 there is provided, according to the invention, a pivotable arm 6 which at its free end carries a holding means in the form of a pair of tongs 7 (see FIG. 3) for the link stud 5. The arm 6 is mounted on a vertical axis 8 which is rotatably journalled on the machine frame 1, said axis having a lower gear wheel 9 meshing with a gear rack 11 connected to the piston of a cylinder 10, so that the arm 6, by means of the, e.g., pneumatically operable cylinder 10, can be pivoted back and forth at will (arrows $P_1$ and $P_2$) between the "collecting position" shown in dot-dash lines in FIG. 1 and the "delivery position" shown in solid lines.

The tongs 7 are movable to a certain extent relative to the free end of the arm 6, the tongs being supported by a link device 12 comprising two parallel links 13, 14 pivotably journalled on vertical axes on the arm. The outer ends (away from the arm) of these links 13, 14 are pivotably connected to a cross piece 15 carrying the tongs 7. By means of a traction spring 16 inserted between the arm 6 and the link 14, the link device 12 is spring-loaded towards a first end position, i.e., the position shown to the left in dot-dash lines, this end position being defined by a first stop 17 disposed, preferably adjustably, on the arm 6 for co-operation with the link 13. Now, when the arm 6 is pivoted towards the fully drawn delivery position, shown in solid lines in the final stage of this pivoting movement, a guide means in the form of a guide roller 18 mounted on the machine frame 1 will control the link device 12 by co-operation with a cam 19, likewise spring-loaded and mounted on the link 13. However, the compression spring 20 acting on the cam 19 is stiffer than the traction spring 16, and the link device 12 will therefore swing away from said first end position and cause a corresponding parallel displacement of the cross piece 15 and of the tongs 7 carried by the latter, whereupon the link 14 may reach the other stop 21 defining the second end position. Preferably, the stop 21 is adjustably disposed on the arm 6. If desired, damping means (not shown) can also be arranged to damp the movement towards each or both end positions. Thus, in the final stage of the pivoting motion of the arm 6 towards the delivery position, the tongs 7 will be accurately guided so as to move practically rectilinearly at right angles to the plane defined by the chain link 4, and therefore the link stud will be fitted exactly into a well-defined position with a rather small clearance to the opposite long sides of the link 4. Now, when the press head 3 is struck with great force (such as 900 Mp) against the link 4 to clamp the stud 5, the tongs 7 will follow the movement of the stud 5 towards the pressing head 2, while the link device 12 is pivoted around the respective pins against the action of the rather stiff compression spring 20. Upon actuating the tongs 7 into delivery position, the arm 6 is pivoted by means of the cylinder 10 back to the position shown in dot-dash lines, wherein a cam projection 22 on the free end of the arm abuts a damping device 23 and a stationary stop 24.

Figure 2:
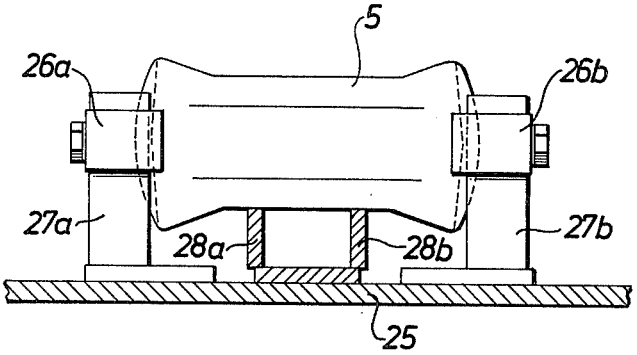
FIG. 2 is a side view of a link stud placed in a holder on a stud feeding table.

In the collecting position, the tongs 7 are placed above a substantially circular table 25 serving as a link stud feeding device having a number of holders (see FIG. 2) distributed circumferentially and comprising inner and outer clamping brackets 26*a* and 26*b*, secured to block members 27*a* and 27*b*, respectively, and a support member situated centrally therebetween in the form of two annular, inner and outer rails 28*a* and 28*b*, respectively, extending around the table. The table is rotatable step by step in the direction of the arrow $P_3$, and new link studs 5 are successively added, preferably automatically, by non-illustrated means, e.g., at 29. As indicated by the arrows $P_4$ and $P_5$ in FIG. 3, the table 25 is also vertically movable, e.g., when the tongs 7 are to grip and "collect" a new link stud 5. In this process, the table is first lifted from the position shown in solid lines in the direction of the arrow $P_5$, so that the link stud 5 reaches the position shown in dot-dash lines to the left in FIG. 3, whereupon the table 25 is rotated (in the direction of the arrow $P_3$ in FIG. 1) one step and the link 5 is positioned between the upper and lower jaws 30 and 31, respectively, of the tongs 7. The lower jaw 31 is located in the space between the rails 28*a*, 28*b* and supports the horizontal, lower surface of the link stud, whereas the upper jaw 30 by means of a pneumatic cylinder 32 is brought into clamping contact with the upper horizontal surface of the link stud which is octagonal in cross-section. When lowering the table 25 again in the direction of the arrow $P_4$, the link stud 5 is held by the tongs 7 and, simultaneously, the holding means 26-28 of the table are likewise lowered so as to enable the tongs 7 and the link stud 5 to be freely swung by means of the arm 6 (in the direction of the arrow $P_1$ in FIG. 1) into delivery position, the above-mentioned accurate guidance into an exact position in relation to a new chain link 4 being repeated.

We claim:

1. A device for inserting a link stud (5) into a chain link (4) to permit a subsequent fastening of the link stud in the chain link, comprising (a) a pivotably mounted arm (6) operatively connected to a stud fastening station (2,3), said arm carrying at its free end an operable holding means (7) for holding said link stud (5) and being pivotable between a collecting position adjacent a link stud feeding device (25) and a delivery position adjacent said stud fastening station (2,3), (b) said holding means being resiliently mounted (12) at the free end of said arm so as to enable guiding of said holding means (7) into a predetermined position relative to a chain link (4) situated in said stud fastening station (2,3).

2. A device according to claim 1, wherein said holding means (7) is resiliently movable relative to said arm (6) in the pivot plane of the latter.

3. A device according to claim 1, wherein said holding means (7) is journalled to the arm (6) by means of at least one link (13,14) loaded by resilient means (16).

4. A device according to claim 3, wherein said holding means is journalled to said arm (6) by means of a link device (12) having two parallel links (13,14).

5. A device according to claim 4, comprising a stationary guide member (18) disposed adjacent said stud fastening station (2,3) and enabling said guiding of said holding means (7) into said predetermined position, and a cam or guide means (19) disposed on one (13) of said parallel links for cooperation with said stationary guide member (18).

6. A device according to claim 5, wherein said guide means (19) is mounted on one of said parallel links (13) by means loaded by resilient means (20) the spring hardness of which is greater than that of the resilient means (16) acting between said link (13,14) and said arm (6).

7. A device according to claim 1, comprising a stationary guide member (18) disposed adjacent said stud fastening station (2,3) and enabling said guiding of said holding means (7) into said predetermined position.

8. A device according to claim 7, wherein said guide member comprises at least one guide roller (18).

9. A device according to claim 7, wherein said holding means (7), by means of said arm (6) and said stationary guide member (18), is adapted to insert said link stud (5) substantially rectilinearly transversely to the longitudinal axis of said link stud fastening station during the last part of the pivotal movement of said arm towards said delivery position.

10. A device according to claim 1, wherein said holding means (7) is spring-loaded (16) towards a first end position defined by a first stop means (17) on the free end of the arm (6), said holding means (7) being in said first end position when situated in said collecting position, and that during the last part of the pivot motion ($P_1$) of said arm towards said delivery position, said holding means (7) is adapted to be guided (18,19) against the action of its spring means (16) towards a second end position defined by a second stop means (21) on the free end of said arm (6).

11. A device according to claim 10, comprising a shock damper for damping the motion of said holding means (7) against at least one of said end positions.

12. A device according to claim 1, wherein said holding means (7) comprises a pair of remotely operable tongs.

13. A device according to claim 12, wherein during the pivotal movement of said arm (6) said tongs (7) are kept in one and the same horizontal plane, whereas said link stud feeding device (25) is vertically ($P_4$,$P_5$) adjustable.

14. A device according to claim 13, wherein said link stud feeding device comprises a vertically adjustable and rotatable table (25) having link stud holders (26-28) distributed about its rotary axis.

* * * * *